US006884226B2

(12) United States Patent
Pereira

(10) Patent No.: US 6,884,226 B2
(45) Date of Patent: Apr. 26, 2005

(54) CRIB PATTING DEVICE

(76) Inventor: Fred Pereira, P.O. Box 808, Kailua-Kona, HI (US) 96745

( * ) Notice: Subject to any disclaimer, the term of this patent is extended or adjusted under 35 U.S.C. 154(b) by 0 days.

(21) Appl. No.: 10/681,202

(22) Filed: Oct. 9, 2003

(65) Prior Publication Data

US 2005/0000017 A1 Jan. 6, 2005

Related U.S. Application Data

(60) Provisional application No. 60/483,910, filed on Jul. 2, 2003.

(51) Int. Cl.[7] ..... A47D 15/00; A47D 9/04

(52) U.S. Cl. ..... 601/54; 5/109; 601/59; 601/92; 601/93; 601/108

(58) Field of Search ..... 5/109, 108, 658, 5/915; 601/54, 59, 92, 93, 108

(56) References Cited

U.S. PATENT DOCUMENTS

| | | | | | |
|---|---|---|---|---|---|
| 928,415 | A | * | 7/1909 | Wilson et al. | 5/109 |
| 3,225,365 | A | * | 12/1965 | Miller et al. | 5/109 |
| 3,261,032 | A | | 7/1966 | Reardon | |
| 3,529,311 | A | | 9/1970 | Crawford | |
| 3,653,080 | A | * | 4/1972 | Hafele | 5/108 |
| 4,231,126 | A | * | 11/1980 | Hurkett | 5/674 |
| 4,951,331 | A | | 8/1990 | Pereira | |
| 5,107,555 | A | * | 4/1992 | Thrasher | 5/109 |
| 5,381,572 | A | * | 1/1995 | Park | 5/600 |
| 6,142,963 | A | | 11/2000 | Black et al. | |
| 6,485,442 | B1 | * | 11/2002 | Batula | 601/87 |

* cited by examiner

*Primary Examiner*—Alexander Grosz
(74) *Attorney, Agent, or Firm*—Patent & Trademark Services Inc.; Joseph H. McGlynn

(57) ABSTRACT

A crib accessory that can be placed beneath an infant's mattress or crib. A movable plate is rhythmically moved up and down to pat the crib mattress and soothe the infant.

18 Claims, 3 Drawing Sheets

CRIB PATTING DEVICE

Applicant claims priority of Provisional application Ser. No. 60/483,910, filed Jul. 2, 2003.

BACKGROUND OF THE INVENTION

This invention relates, in general, to accessories for cribs, and, in particular, to accessories for cribs which make a patting sound or vibration to soothe an infant by rhythmically contacting the bottom of the crib.

DESCRIPTION OF THE PRIOR ART

In the prior art various types of accessories for cribs have been proposed. For example, U.S. Pat. No. 6,142,963 to Black et al discloses a crib patting device with two hinged elements that are separated by the action of a rotatable cam.

U.S. Pat. No. 4,951,331 to Pereira discloses a crib patting device which has an adjustable frame to place a patting device against the bottom of a crib.

U.S. Pat. No. 3,529,311 to Crawford discloses a crib bouncer which has a bouncer housing connected to the bottom of the crib and a cam to operate the device.

U.S. Pat. No. 3,261,032 to Reardon discloses a crib rocking device which uses an electromagnet to operate the device.

SUMMARY OF THE INVENTION

The present invention is directed to a crib accessory that can be placed beneath an infant's crib. A movable plate is rhythmically moved up and down to pat the crib and soothe the infant.

It is an object of the present invention to provide a new and improved crib patting device.

It is an object of the present invention to provide a new and improved crib patting device that can easily moved beneath the crib.

It is an object of the present invention to provide a new and improved crib patting device which can be powered by a variety of devices.

These and other objects and advantages of the present invention will be fully apparent from the following description, when taken in connection with the annexed drawings.

DESCRIPTION OF THE PREFERRED EMBODIMENT

Figure 1:
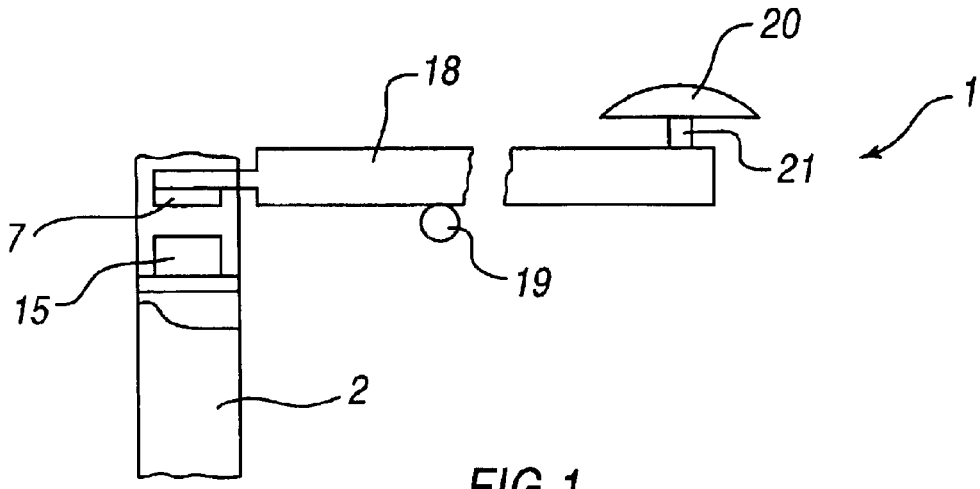
FIG. 1 is a schematic view of the present invention.
Figure 2:
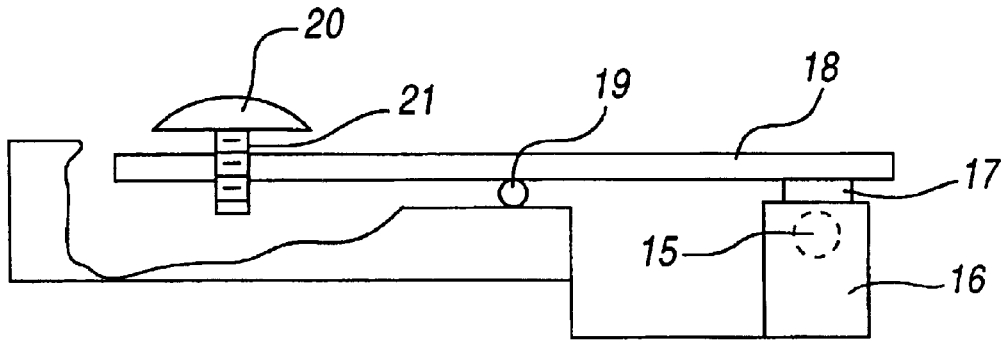
FIG. 2 is a partial side view of another embodiment of the present invention.

Referring now to the drawings in greater detail, FIG. 1 shows a schematic view of the present invention 1. A casing or support 2 holds an electro magnet 15 attached thereto in any conventional manner. A metal plate 7 is attached to an arm 18 which pivots about pivot point 19. A pad 20, similar to pad 20 in FIG. 2, is mounted on the end of arm 18 by threaded post 21. When magnet 15 is energized, it attracts plate 7 downwardly, which raises the opposite end of arm 18 (i.e. the end with pad 20). When pad 20 is raised it will apply a patting motion to the underside of a crib or mattress on the crib, which will sooth an infant on the mattress. When the magnet 15 is de-energized, the weight of the baby will force the end of the arm 18 with the pad 20 downward.

The device shown in FIG. 2 accomplishes the same result as the FIG. 1 device in a slightly different manner. A piston 17 is mounted in a housing 16 and moves up and down under the control of an electro magnet or solenoid 15 similar to the operation of the plate 7 and the magnet 15 in FIG. 1. Piston 17 is attached to arm 18 in any conventional manner. As the piston 17 moves down from the position shown in FIG. 2 under the pull of the magnet or solenoid 15, it pulls arm 18, which pivots on bar 19, downward. The left side of arm 18 (as seen in FIG. 2) has a pad 20 which will strike the bottom of the crib mattress when the right side of the arm 18 is moved downward. Pad 20 is connected to arm 18 by a screw threaded post 21 which engages in a threaded aperture in arm 18 so the height of the pad 20 can be adjusted up and down. The magnet/solenoid 15, used in the FIGS. 1 and 2 devices, can be operated by an AC or DC source which has a conventional switch which cycles to turn on and off the magnet/solenoid 15.

Figure 3:
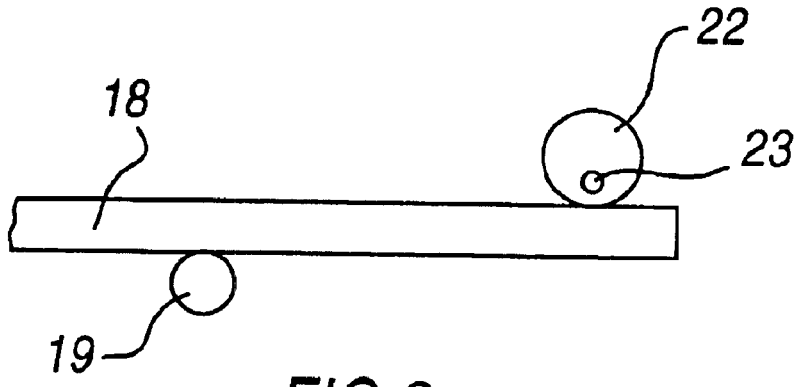
FIG. 3 is a partial view of another embodiment of the present invention.

The FIG. 3 device uses the same arm 18 and pivot point 19 as used in the FIG. 2 device, however the arm 18 is moved in an up and down manner by a cam 22 which is eccentrically mounted at 23. The cam 22 can be powered by any conventional motor (not shown). As the cam rotates it will push the right side of arm 18 down, which will raise the left side of arm 18 (as seen in FIG. 3), with the pad 20 (not shown in FIG. 3 for clarity) which will pat the crib in the same manner as the FIG. 2 device.

Figure 4:
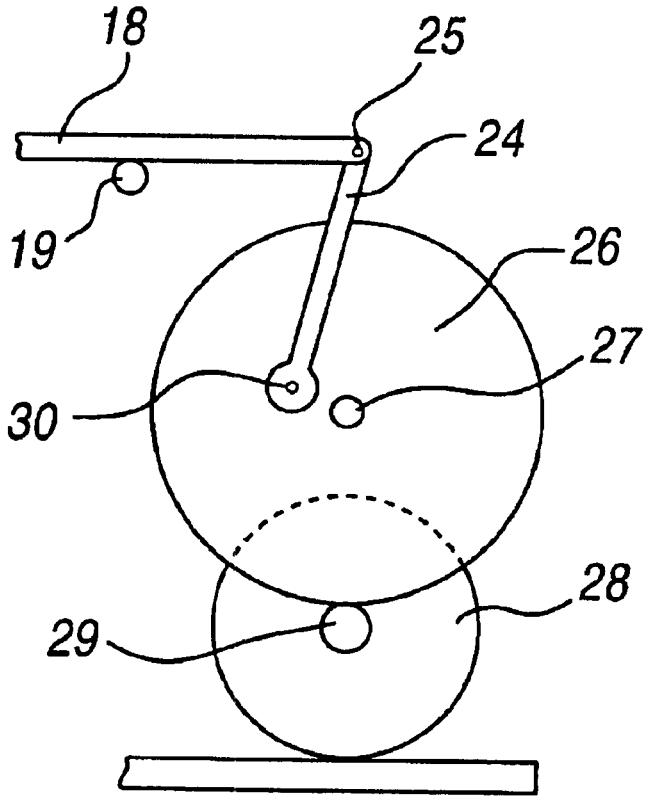
FIG. 4 is a partial view of another embodiment of the present invention.

The FIG. 4 device is another type of moving means for moving the arm 18 about the pivot point 19. In this device a motor 28 rotates a rubber wheel 29. The wheel 29 rotates wheel 26 about point 27. An arm 24 is connected at one end to wheel 26 at point 30, and at the other end to arm 18 at point 25. As wheel 26 rotates, arm 24 will move up and down, which will move arm 18 up and down, which will raise the left side of arm 18, with the pad 20 (not shown in FIG. 4 for clarity), which will pat the crib in the same manner as the FIG. 1, FIG. 2 and FIG. 3 devices.

Figure 6:
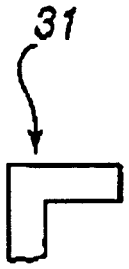
FIG. 6 is a partial view of one of the elements of the FIG. 5 device.
Figure 5:
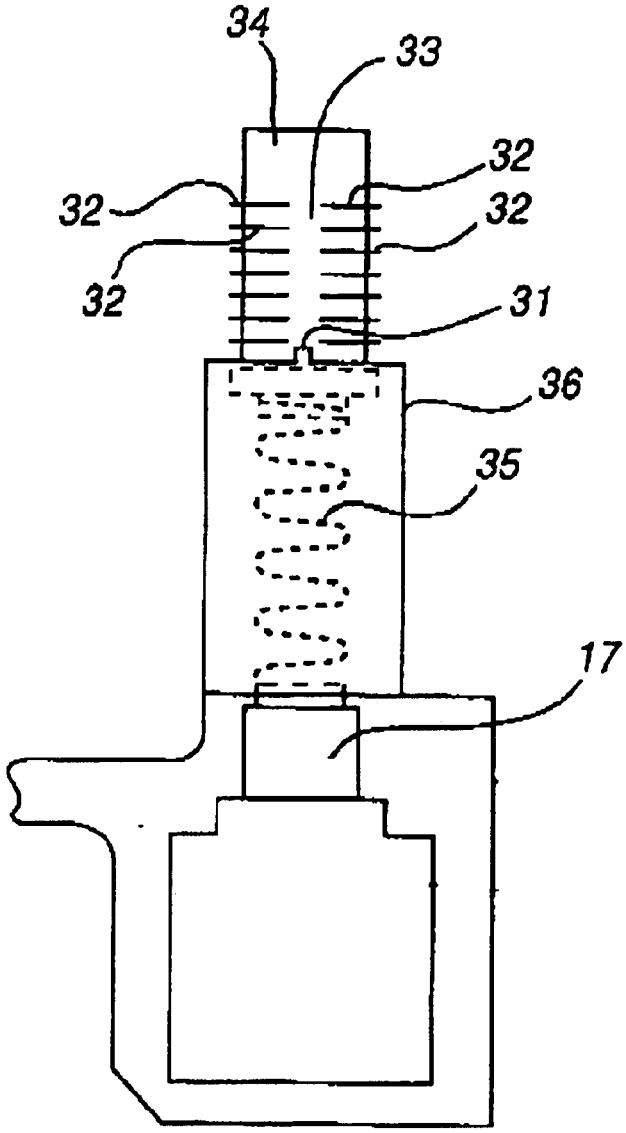
FIG. 5 is a partial view of another embodiment of the present invention.

The device shown in FIG. 5 is an adjustment device for placement between piston 17 an arm 18 as shown in FIG. 2. A housing 36 holds a spring 35 above the piston 17. The housing 36 would incase the piston 17 and the spring 35, as shown in FIG. 5. The housing has an adjustment device 34 secured to the top of the housing. The device 34 has a plurality of spaced projections 32 which are spaced in a vertical direction along the outer surface of the device 34 to form rows between the spaced projections 32. The projections 32 are also spaced in a horizontal direction to form at least one slot 33 between the projections. The housing has a right angle projection (see FIG. 6) at the top of the housing. The device 34 can be moved up and down within the housing 36 by aligning the projection 31 with the slot 33, moving the device, and when the device is positioned as desired by the user, rotating the device 34 until the projection 31 is placed between two of the projections 32, which will lock the device 34 with respect to the housing 36. Moving the device 34 down into the housing will compress spring 35, which will make it easier for the piston to move the arm 18 down.

Although the Crib Patting Device and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A device adapted to be removably positioned beneath, and spaced from the underside of a crib, the device adapted to transmit a vibration and produce a sound by rhythmically patting or contacting the underside of the crib, to thereby soothe a user of the crib, comprising:

means for rhythmically engaging and disengaging the underside of the crib means for moving said means for engaging an underside of the crib in a substantially vertical direction, said means for engaging an underside of a mattress being mounted on one end of a horizontal arm, and said means for moving said means for engaging an underside of the crib in a substantially vertical direction being mounted on another end of said horizontal arm.

2. The crib patting device as claimed in claim 1, wherein a pivot point is positioned beneath said horizontal arm, and said means for engaging an underside of the crib is mounted on one side of said pivot point, and said means for moving said means for engaging an underside of the crib in a substantially vertical direction is mounted on another side of said pivot point.

3. The crib patting device as claimed in claim 1, wherein said means for engaging an underside of the crib is a pad, said pad is secured to said horizontal arm by a threaded post.

4. The crib patting device as claimed in claim 1, wherein said pad is mounted on an upper surface of said horizontal arm.

5. The crib patting device as claimed in claim 1, wherein said means for moving said means for engaging an underside of the crib in a substantially vertical direction is a metallic plate and a means for attracting said metallic plate, said metallic plate being secured to said another end of said horizontal arm, and said means for attracting said metallic plate is mounted beneath said horizontal arm.

6. The crib patting device as claimed in claim 5, wherein said means for attracting said metallic plate is an electro magnet.

7. The crib patting device as claimed in claim 5, wherein said means for attracting said metallic plate is a solenoid.

8. The crib patting device as claimed in claim 1, wherein said means for moving said means for engaging an underside of the crib in a substantially vertical direction is a cam.

9. The crib patting device as claimed in claim 8, wherein said cam is eccentrically mounted above a top surface of said horizontal arm and engages said top surface as it rotates.

10. The crib patting device as claimed in claim 1, wherein said means for moving said means for engaging an underside of the crib in a substantially vertical direction is a second arm which is secured at one end to said horizontal arm, and said second arm is secured at another end to a wheel, and means for rotating said wheel.

11. The crib patting device as claimed in claim 10, wherein said second arm is secured to said wheel at a point offset from a center of said wheel.

12. The crib patting device as claimed in claim 10, wherein said means for rotating said wheel is a second wheel, said second wheel engages a circumference of said wheel.

13. The crib patting device as claimed in claim 12, wherein said second wheel is rotated by a motor.

14. The crib patting device as claimed in claim 1, wherein said means for moving said means for engaging the underside of the crib in a substantially vertical direction is a piston.

15. The crib patting device as claimed in claim 14, wherein said piston is mounted in a housing, and an adjustment means for adjusting the distance between said piston and said horizontal arm is mounted above said piston.

16. The crib patting device as claimed in claim 15, wherein said adjustment means comprises:

a plurality of ribs, said ribs being positioned on an outer surface of said adjustment means, said ribs being spaced in a vertical direction whereby a plurality of rows are created between said ribs, and said housing has a projection which fits into said rows to hold said adjustment means in a plurality of vertical positions.

17. The crib patting device as claimed in claim 16, wherein said ribs are spaced in a horizontal direction so that at least one slot is formed between said ribs, and said projection fits in said slot to move said projection between said rows.

18. The crib patting device as claimed in claim 16, wherein a spring is mounted between said adjustment means and said piston.

* * * * *